United States Patent [19]

Bessen

[11] 4,031,274

[45] June 21, 1977

[54] METHOD FOR COATING CAVITIES WITH METAL

[75] Inventor: Irwin I. Bessen, Cincinnati, Ohio

[73] Assignee: General Electric Company, Cincinnati, Ohio

[22] Filed: Oct. 14, 1975

[21] Appl. No.: 622,376

[52] U.S. Cl. ..... 427/229; 427/239; 427/380; 427/383 D; 427/405; 428/555

[51] Int. Cl.[2] ..... C23C 3/04

[58] Field of Search ..... 427/383 D, 376 H, 229, 427/252, 253, 405, 380

[56] References Cited

UNITED STATES PATENTS

| | | | |
|---|---|---|---|
| 2,653,879 | 9/1953 | Fink | 427/252 |
| 3,041,197 | 6/1962 | Berger | 427/229 X |
| 3,158,499 | 11/1964 | Jenkin | 427/229 X |
| 3,375,129 | 3/1968 | Carley et al. | 427/252 |
| 3,434,879 | 3/1969 | Langley | 427/229 |
| 3,640,815 | 2/1972 | Schwartz | 427/252 X |
| 3,667,985 | 6/1972 | Levine et al. | 427/253 |
| 3,900,613 | 8/1975 | Galmiche et al. | 427/252 X |

*Primary Examiner*—Ralph S. Kendall
*Attorney, Agent, or Firm*—Lee H. Sachs; Derek P. Lawrence

[57] ABSTRACT

An article having an outer surface and an inner cavity, such as a hole or channel with a metallic inner surface, is provided with an inner metallic coating on the inner surface and, in one form, an outer metallic coating on the outer surface. The inner coating is provided as a result of decomposition and subsequent thermal homogenization of one or more organic compounds including Al, Cr or Ni or alloys including one or more of those elements. The outer coating can be the same as the inner coating or can be a metallic coating of one of a variety of known metallic coatings.

9 Claims, 4 Drawing Figures

500 X

1000 X

250 X

METHOD FOR COATING CAVITIES WITH METAL

BACKGROUND OF THE INVENTION

This invention relates to metallic coatings and, more particularly, to metallic coatings including aluminum applied to internal and external surfaces of an article.

An important effort in the evolution of gas turbine engines has been the development of high temperature operating coatings to protect the surface of certain engine components from environmental attack and degradation. Generally, such higher temperature operating components are of a metal based on an element selected from Fe, Co, Ni and Ti. The more advanced designs of such components as turbine blades included such cavities as channels and small holes within the blade and communicating with various surface portions of the blade to allow a cooling fluid such as air to pass through and reduce the temperature of such a component.

Although there have been reported a wide variety of coatings and methods for applying coatings to the outer surface of such components, the ability of such methods to coat the internal surfaces of small holes, channels and other internal cavities is greatly restricted. For example, the diffusion aluminiding process of the general type described in U.S. Pat. No. 3,667,985 — Levine et al, issued June 6, 1972, used for external coatings, is limited in throwing power, i.e., in its ability to coat very far into holes with high length/diameter ratios. Similarly, electoplating techniques cannot plate inside narrow chambers or holes because electric fields are excluded. Physical vapor deposition and thermal spraying are essentially line-of-sight processes that cannot deposit on the hole surfaces.

SUMMARY OF THE INVENTION

It is a principal object of the present invention to provide an improved method for coating an article on a surface of an inner cavity using a method which is compatible with the composition and thermal mechanical properties of the substrate material.

A further object is to provide an improved method for coating an article both on its outer surface as well as on a cavity inner surface using a method for each surface which includes compatible processing steps.

Another object is to provide a metod for depositing aluminum or an alloy of aluminum on the surface of the inner cavity and then aluminiding the outer surface of the article employing thermal conditions which at the same time heat treats and honogenizes the coating on the inner surface.

Still another object is to provide a coated article having a coating on its outer surface and a thermally decomposed and homogenized type of coating on the inner surface of a cavity.

These and other objects and advantages will be more clearly understood from the following detailed description, the drawings and the specific examples, all of which are intended to be typical of rather than in any way limiting on the scope of the present invention.

Briefly, the method associated with the present invention, in one form, includes the steps of contacting the metallic inner surface of an article with an organic compound or mixture of organic compounds which include a metal selected from Al and alloys including Al, such compound being capable of decomposition, such as thermal decomposition, to provide the metal as a deposit, the term "metal" being intended herein to include alloys. Then the article is either heated to diffuse the deposit and substrate elements in a desirable way, or the outer surface of the article is subjected to a separate coating process which includes a thermal treatment in a particular range that will cause the coating deposit on the inner surface to diffuse with substrate elements in a desirable way. In a second form the method includes the steps of contacting the inner surface of a heated article cavity with a sequential series of individual or mixed organic compounds which include one or more metals or alloys selected from aluminum, chromium, nickel or their alloys or mixtures, such organic compounds being capable of decomposition, such as thermal decomposition, to provide a deposit of the metals or alloys. The subsequent heating then causes the coating deposits to interdiffuse with each other and with substrate elements.

The article associated with the present invention, in one form, includes on the inner surface of an alloy based on an element selected from Fe, Co, Ni and Ti a first or inner coating of a metal selected from aluminum and alloys including aluminum. The inner coating has a structure characterized by either (a) a single layer of pure aluminum, or (b) a plurality of single metal portions or layers of elements diffused together constituting an alloy including aluminum, or (c) a single alloy layer, or (d) a layer consisting of a mixture of elements or phases that constitute the alloy. In any event, the inner coating is characterized by a coating metal activity sufficient to form, in an oxidizing atmosphere, a protective scale which includes at least one of the oxides of Al and Cr or the spinels including at least one of Al and Cr.

The outer surface of the article includes a second or outer coating which may be identical to, and produced in the same manner as, the inner coating on the inside of the article, or it may be a different metallic coating produced by one of a variety of known methods which are readily adaptable to the metallic coating of the exterior of articles. In one form, the outer surface can include an outer coating applied by a diffusion process, such as that described in the above-mentioned U.S. Pat. No. 3,667,985, that provides the thermal energy to interdiffuse the elements deposited on the interior of the article with each other and with the internal surface of the substrate article material. In another form, the outer surface may include as an outer coating a physical vapor deposit processed in a temperature range that is suitable for the interdiffusion of the elements deposited on the interior surface of the article with each other and with the substrate article material.

It will be apparent to those versed in the art of coating that conventional coating processes as may be applied to the exterior of articles cannot be applied with complete coverage to the internal cavities of articles, particularly those with cavities that open to the exterior surface through long, small diameter holes. For example, pack cementation processes for depositing aluminum or alloys or aluminum do not have the throwing power to coat internal cavities or long narrow holes extending to the exterior surface of an article. Similarly, thermal spray coating methods, electrolytic plating, and physical vapor deposition do not have the throwing power required to coat entire surface areas of internal cavities through small diameter long holes. An important feature of the present invention is the provision of a fluid which can be flushed into the internal cavities of an article through small holes connecting to the exterior surface, thereby effecting complete and uniform coverage by thermal decomposition of the fluid. Another important feature of one form of the present invention is the formulation of sequential flushing procedures and thermal treatments with specially selected organic compounds containing aluminum or other elements of alloys including aluminum to provide environmental protection to the internal surfaces.

DESCRIPTION OF THE PREFERRED EMBODIMENTS

Figure 1:
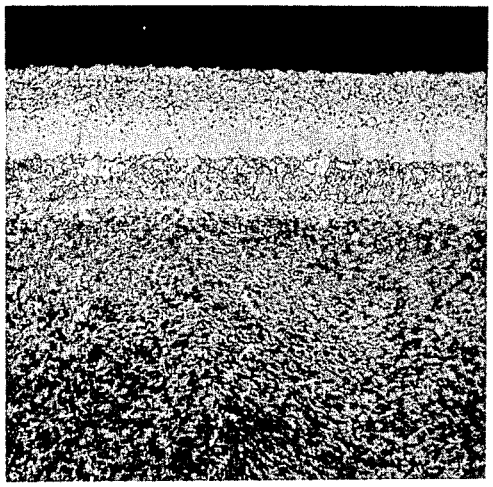
FIG. 1 is a photomicrograph at 500 magnifications showing the surface portion of an article coated in accordance with the present invention.

There are a variety of metallic compounds, generally organometallic compounds, which have the characteristic of decomposing at relatively low temperatures to provide a metal in free form and a gaseous product. In one reported use of such a compound to provide a coating, sometimes called chemical vapor deposition, the vapor of such a compound is decomposed at a heated surface so that metal is caused to deposit in a substantially pure and dense state. Frequently, organoaluminum compounds are used to deposit aluminum in this way. However, such chemical vapor deposition frequently involves the use of a reactant, such as triisobutylaluminum, hereinafter referred to as TIBA, which in pure form ignites in air, reacts violently with water, and burns the skin severely on contact. Such compound was used in the evaluation of the present invention modified by dissolving TIBA in a hydrocarbon, such as kerosene. In this way there is obtained a solution that can be exposed to air with little danger and with relatively minor effect on skin.

Thus, the coating of the present invention on the inner surface of a cavity, in one evaluation of the present invention, was applied under inert atmosphere by decomposing TIBA from a 20 – 30 weight percent solution in kerosene by flushing such solution through the inner surfaces of cavities in a gas turbine engine blade heated in the range of about 160° – 220° C. Below about 160° C, deposition of Al does not occur. The blade was made of a nickle-base superalloy, sometimes referred to as Rene' 80 alloy, and described in U.S. Pat. No. 3,615,376 — Ross, issued Oct. 26, 1971. Such alloy included nominally, by weight, 0.17% C, 14% Cr, 5% Ti, 0.015% B, 3% Al, 4% W, 4% Mo, 9.5% Co, 0.06% Zr, with the balance essentially Ni. Such cavities, which in this case were small holes through the airfoil of the blade, can be generated by a variety of means well known in the art. In this example, the holes were generated through the use of electrolytic drilling. After deposition of the decomposition coating on the inner surface of the cavity, such deposit was freed from volatile materials by heating at a low temperature, such as about 450° F (about 230° C) for about 10 minutes, within the broader range of about 300° – 700° F (about 150° – 370° C). The article was then raised in a predetermined time to a temperature sufficiently high to permit interdiffusion of the aluminum deposit with the Rene' 80 alloy inner surface. Such a temperature was about 1925° F (about 1050° C) in the broader range of about 1600° – 2000° F (about 870° – 1100° C), and preferably 1800° – 2000° F (980° – 1100° C), achieved during a period of about 20 – 30 minutes. Thus, the preferred programmed time-temperature cycle of the present invention, in this example, was heating in the range of about 300° – 700° F (about 150° – 370° C) and then increasing the temperature during the next 20 – 30 minutes to about 1800° – 2000° F (980° – 1100° C). The result was an article, including a cavity inner surface coating, having a structure characterized by the diffusion of aluminum into the cavity surface substrate and by the diffusion outwardly into the coating of nickel nd chromium from the cavity surface René 80 alloy substrate, as evidenced by a beta NiAl outer layer, with isolated small chromium phases, and a diffusion zone including gamma prime $Ni_3Al$, carbides and other phases.

In another evaluation of the present invention, a gas turbine engine blade, which was made of the above-described René 80 nickel-base superalloy, first was cleaned by vapor honing and then was heated in the preferred 180° – 220° C temperature range within an inert gas enclosure which also included a bath of the above-described TIBA kerosene solution. During immersion and while the turbine blade was still hot, aluminum was deposited on all internal and external surfaces. The deposition of aluminum stopped when the temperature of the blade became too low, for example below about 160° C, through the loss of heat to the kerosene solution. Following the deposition of aluminum, the blade was removed from the solution, rinsed, dried and then heated to about 600° F (about 315° C) for volatilization of kerosene, organic compounds and water. Then it was quickly heated to a high temperature in the 980° – 1100° C range, specifically about 1050° C to permit the interdiffusion of the deposited aluminum with the René 80 alloy. Thus, the inner and outer surfaces of the blade were characterized by the diffusion coating structure in which aluminum was diffused into the René 80 alloy substrate and nickel and chromium from the René 80 alloy was diffused outwardly. This was evidenced by a beta NiAl outer layer with isolated small chromium phases and a diffusion zone consisting of gamma prime $Ni_3Al$ carbides and other phases.

EXAMPLES 1 – 7

In more specific evaluations of the present invention, a series of the above-described René 80 alloy turbine blades, including cooling passages communicating with the surface of the blade airfoil, were coated on the inner surfaces of such cavities by passing a kerosene solution of about 20 wt. % TIBA through the blade cavities or passages while the blade was heated inductively to provide at the inner surface of the cavities a temperature of between about 180° – 260° C. The internal coating generated ranged in thickness from about 0.1 to about 3.8 mils. The following Table I summarizes the various parameters, coating thicknesses and coating appearances in these examples:

TABLE I

| EXAMPLE | WALL TEMP °C | COATING TIME(hr) | INTERNAL COATING DATA (20 wt. % TIBA concentration) SOLUTION FEED RATE (cm³/min) | COATING Wt (g) | COATING Thickness (mils) | COATING APPEARANCE |
|---|---|---|---|---|---|---|
| 1 | 240–260 | 0.5 | 25 | .9 | 3.8 | 75% of holes plugged with porous Al |
| 2 | 220–240 | 0.3 | 13 | .5 | 2.0 | Powder, dull |
| 3 | 180–200 | 0.5 | 13–17 | .02 | .1 | White appearance |
| 4 | 200 | 1. | 13 | .1 | .5 | White appearance polishes to a bright finish |
| 5 | 200 | 1.5 | 13 | .2 | .7 | White appearance |
| 6 | 200 | 2. | 13 | .4 | 1.7 | White appearance |
| 7 | 200 | 1.5 | 13 | .2 | .9 | White appearance |

From these and other examples, it has been determined that heating the surface to which the aluminum is to be applied from the decomposition of TIBA at a temperature above about 220° C, an undesirable porous, powdery deposit results. In addition, it has been recognized that at temperatures below about 180° C, the deposition rate is very slow with the decomposition of aluminum stopping below about 160° C. Therefore, in the preferred form of the method associated with the present invention, the temperature of the inner surface upon which the aluminum is to be deposited as a result of decomposition of the organometallic compounds is in a temperature range of about 180° C to about 220° C with the specific preferred temperature being about 200° C. The preferred deposit thickness is in the range of about 0.1 to less than about 2 mils in order to avoid plugging of the specific cavities involved in these examples and the generation of a powdery coating.

EXAMPLE 8

In another series of evaluations, 1 mil deposits applied as in the above examples were heated in a non-oxidizing atmosphere, for example in a vacuum or in an inert atmosphere, at about 600° F (about 315° C) for a time sufficient to drive off volatile materials such as gases, after which the temperature was raised within 30 minutes, and preferably about 20 minutes, to a temperature of about 1950° F (about1066° C) where it was held for about 4 hours prior to being cooled to about 500° F (about 260° C) before opening to the atmosphere. It has been found, as shown by comparison of this example with the following examples, that the heat treatment associated with the present invention is critical in order to obtain a structure which is characterized by a beta NiAl outer layer and a diffusion zone between the outer layer and substrate, the outer layer being about twice the thicknesses of the diffusion zone. In these examples, the sum of both thicknesses was about 2 mils.

Figure 2:
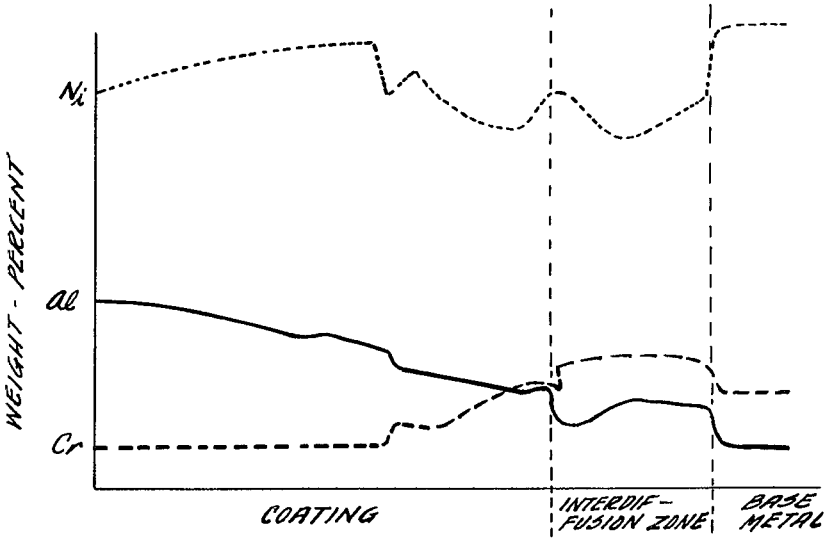
FIG. 2 is a graphical presentation of an electron microprobe analyzer trace across the coated portion of FIG. 1.

The microstructure so obtained is shown in the photomicrograph of FIG. 1 at 500 magnifications and is typical of a pack aluminided coating of high Al activity with subsequent ductilizing thermal treatment. An electron microprobe analyzer trace across the coating also is typical and is shown in FIG. 2. The oxidation and corrosion resistance of coatings defined by this type of microstructure is known in the art to be very good.

As has been stated above, a critical heat treatment is required by the present invention for the decomposition coating applied to the inner surface in order to generate a desired final coating structure. It was recognized that such a structure and heat treatment could be accomplished concurrently with the application of an aluminide coating to the outer surface of the article being protected, in this case a turbine bucket. One aluminide coating process commercially available and widely used in connection with the application of aluminide coatings to gas turbine engine components is the coating method sometimes referred to as CODEP coating, forms of which are described in the above-identified U.S. Pat. No. 3,667,985, the disclosure of which is incorporated herein by reference and made a part hereof. In that method, as in other diffusion aluminiding methods, the coating ordinarily is generated in the range of about 1600° – 2100° F (870° – 1150° C). In the evaluation of the present invention, it has been recognized that its critical heat treatment involves first the evaporation of volatile compounds, for example at about 600° F (about 315° C) and then the heating rapidly through the aluminum melting range up to a temperature at which the internal deposit diffuses into the surface on which it has been applied.

EXAMLE 9

Figure 3:
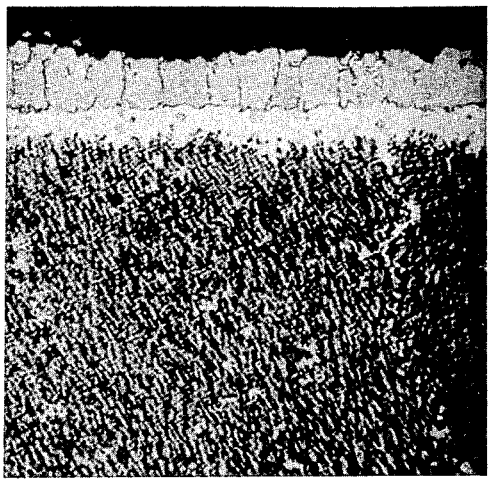
FIG. 3 is a photomicrograph at 1000 magnifications showing another embodiment of the surface portion of an article coated in accordance with the present invention.

A ¼ mil Al deposit was applied to a René 80 alloy turbine blade by the method described in Examples 1 – 7 above, and then treated by heating in an inert atmosphere as follows: first to 600° F (315° C), then in 20 minutes to about 1925° F (about 1052° C), held for 4 hours at that temperature, and then cooled to below about 500° F (about 260° C). The coating, shown in the photomicrograph of FIG. 3 at 1000 magnifications, was about 0.009 inch thick with a fairly large equiaxed grain structure. Comparison to FIG. 1 shows that this coating, which is another embodiment, does not have appreciable, minute sigma phases in the outer coating, indicating a softer structure typical of a relatively lower Al activity pack aluminide process, but of sufficient activity to form, in an oxidizing atmosphere, a protective aluminum oxide scale.

EXAMPLE 10

Figure 4:
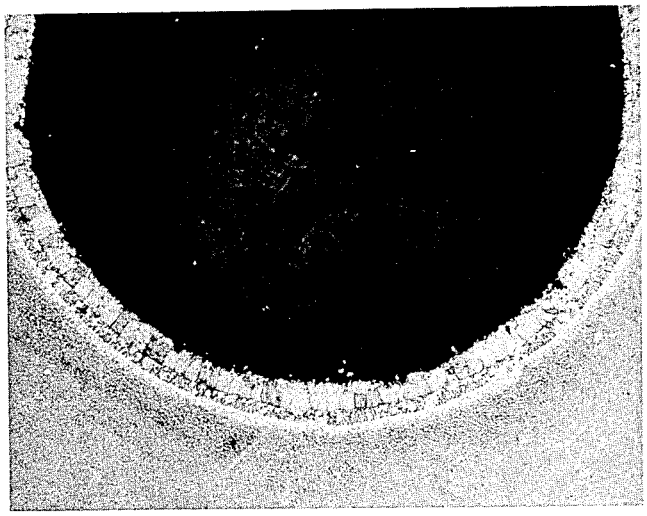
FIG. 4 is a photomicrograph at 250 magnifications of a blade trailing hole coated in accordance with the present invention.

Inner surfaces of internal cavities of a René 80 alloy blade were flushed with the above-described TIBA in kerosene solution by injecting the solution in blade shank entry holes used for engine cooling air. The solution flowed through an internal labyrinth path and drained out of leading edge and trailing edge holes while the blade was heated at a temperature of about 200° C as described above. The photomicrograph of FIG. 4 at 250 magnifications shows the section of the trailing edge holes after the heat treatment of Example 9 which produced the outer layer of beta NiAl and the diffusion zone. Thus, there was provided environmental protection on all internal surfaces, even those not readily accessible to normal or conventional coating procedures, herein defined to mean, but not be limited to, electro or vapor deposition and heated particle deposition as flame or plasma spraying.

EXAMPLE 11

René 80 alloy pins ⅛ inch in diameter and 2 inches long were provided with a deposit from the above-described TIBA-kerosene solution to thicknesses of ½ mil and 1 mil. Subsequently the pins were heated as in Example 2. The pins so coated and treated were placed in a dynamic oxidation tunnel at 1950° F (1066° C) with a gas velocity of 0.05 Mach and cycled to below about 800° F (about 425° C) once per hour. Weight changes if the pins were recorded in Table II below.

After 960hours the ½ mil Al coated and heat treated pins showed pinpoint oxidation; the 1 mil Al coated and heat treated pins were unblemished. The oxidation resistance, by comparison to pack aluminided specimens, was judged to be good. These data presented the need for at least about a 1 mil coating when only aluminide is used.

TABLE II

Oxidation Test - 1950° F Flame Tunnel
René 80 Alloy Base with Al Heat Treated Coating

| Time (hrs) Weight Gain (mg) | 320 | 480 | 640 | 800 | 960 |
|---|---|---|---|---|---|
| 1/2 mil coating | 2.3 | 2.0 | 2.8 | 3.1 | 3.2 |
| 1 mil coating | 2.2 | 1.9 | 2.6 | 2.7 | 3.1 |

EXAMPLE 12

Nickel carbonyl, $Ni(Co_4$, was introduced into an argon atmosphere at a partial pressure of 130mm of Hg, within a chamber which contained an induction-heated, nickel-base superalloy specimen. The specimen, which was a Ni-base superalloy commercially available as IN738 alloy, was heated in this flowing gas mixture to within the effective range of 80° – 300° C, in this example about 100° C, for 15 minutes and then cooled to room temperature. In that time, a 4 mil layer of pure nickel was deposited on the surface of the specimen. Then the specimen was removed from the chamber and introduced into another apparatus containing argon. An argon flow was established in this apparatus by bubbling 15 cc per minute of argon at 1 atmosphere through the above-described kerosene solution of TIBA. The specimen was then heated to 200° C for 15 minutes. This procedure deposited 1 mil of pure aluminum on top of the nickel layer. Then the specimen was put into a hydrogen furnace and heated to 1050° C for 16 hours to homogenize and interdiffuse the two coating layers. The composition of the resulting coating was 12 wt. % aluminum, balance essentially nickel, as would be expected from the proportional thicknesses of aluminum and nickel deposited and characterized by metallic nickel with a carbon impurity and a fine grain structure. The 12 wt. % aluminum-nickel coating offers sufficient oxidation resistance at temperatures typical of the interior of turbine blades. A more oxidation-resistant coating can be produced by prolonging the aluminum coating process step or shortening the nickel coating process step so that substantially equivalent thicknesses of nickel and aluminum are provided. In such case, a beta NiAl alloy coating is formed.

EXAMPLE 13

IN738 nickel-base alloy specimens were placed in the coating apparatus which was evacuated to less than 1 mm of mercury pressure. Liquid dicumene chromium, $(C_7H_8)_2$ Cr was heated to 250° C so that it naturally evaporated under the reduced pressure. The specimen was then heated in the range of 300° – 450° C and preferably 350° – 450° C for 10 minutes using induction heating. In a 10-minute interval at 350° – 450° C, four mils of chromium were deposited. The deposition thickness is dependent on the chromium activity which in turn is proportional to the vapor pressure or the temperature to which the dicumene chromium liquid solution is heated. Next, the specimen including the 4 mil layer of chromium was put into a similar apparatus and coated with the above-described TIBA kerosene solution, as in previous examples. This step deposited 1 mil of aluminum on top of the 4 mils of chromium. The specimen was then homogenized by interdiffusion in a hydrogen furnace at 1050° C for 16 hours. The resulting coating consisted of two portions: an under portion of alpha chromium, and an outer portion consisting of alpha chromium and $Cr_5Al_8$.

In all these examples, the pure coatings deposited by each individual deposition procedure is remarkably uniform in thickness. The thicknesses are controlled essentially by the activity of the organic compound, the specimen temperature distribution and time. The fact that the coating is remarkably uniform in thickness suggests that flowing the reagent fluid through complicated labyrinthine passages on the inside of an article, for example a turbine blade, does not create thicker coatings at the point of entrance and thinner coatings at the point of exit. As shown by these examples, individual successive layers of elements, for example Ni and Al Cr and Al, Ni, Cr and Al, etc., can be deposited within the range of about 100° – 450° C, and then homogenized and interdiffused into a single coating in the range of about 870° – 1100° C. Also, multiple elements can be codeposited as an alloy, for example Ni and Cr, followed by an Al deposit and subsequent homogenization. Although specific examples and embodiments have been included in this description as typical and representative, those skilled in the art will appreciate the variations and modifications of which the present invention is capable without departing from its scope which is intended to be defined by the appended claims.

What is claimed is:

1. In a method for coating an article having an outer surface and a cavity within the article, communicating with the outer surface through a relatively small diameter opening and having a metallic inner surface, the steps of:

contacting the inner surface with a fluid comprising at least one organic compound including at least one metal selected from the group consisting of Al, Cr, Ni and their alloys and mixtures by flowing the fluid through the cavity and the small diameter opening, the compound being capable of decomposition to provide the metal; while heating the inner surface at a first temperature to enable said decomposition to occur and to provide a metal deposit on the inner surface, heating the deposit in a non-oxidizing atmosphere at a second temperature for a time sufficient to remove volatile materials from the deposit; and then, rapidly increasing the temperature of the inner surface and of the deposit to a third temperature in the range of about 870° – 1100° C. within a period of up to about 30 minutes and heating in that range for a time sufficient to interdiffuse the deposit and the inner surface to provide an inner surface coating.

2. The method of claim 1 in which the first temperature is in the range of about 100° – 450° C.

3. The method of claim 2 in which:

the first temperature is in the range of about a. 160° – 220° C when Al is selected;

b. 80° – 300° C when Ni is selected;

c. 300° – 450° C when Cr is selected; and the third temperature is in the range of about 980° – 1100° C.

4. The method of claim 3 for providing the inner surface with an aluminide coating in which:

the inner surface is a metallic material based on Ni;

the inner surface is contacted with a solution of triisobutylaluminum at a concentration of about 20° – 30 weight percent while heating the surface to the first temperature for a time sufficient to provide a deposit of Al on the inner surface;

the second temperature is about 150° – 370° C; and the temperature is increased rapidly through the Al melting range during a period of about 20 – 30 minutes to the third temperature.

5. The method of claim 1 in which the inner surface is contacted with a plurality of organic compounds to codeposit a plurality of elements upon heating at the first temperature.

6. The method of claim 1 in which a plurality of metal deposits are provided from a sequential contacting and heating of the inner surface thereby depositing a plurality of superimposed deposits, the heating to the third tempeature interdiffusing the plurality of deposits and the inner surface.

7. The method of claim 6 in which there is first provided at least one deposit of an element selected from the group consisting of Ni and Cr and then there is provided over such deposit an additional deposit of Al.

8. The method of claim 1 in which the third temperature is provided during a method which provides a metallic coating to the outer surface.

9. The method of claim 8 in which the organic compound contacts both the inner and the outer surfaces while heating the inner and outer surfaces to provide a metal deposit on both the inner and outer surfaces, the heating to the second and third temperature including heating of the deposit on the outer surface and heating of the outer surface to provide an inner surface coating and an outer surface coating.

* * * * *